US005210367A

United States Patent [19]

Taguchi et al.

[11] Patent Number: 5,210,367

[45] Date of Patent: May 11, 1993

[54] AUTOMATIC PERFORMANCE DEVICE FOR A KEYBOARD INSTRUMENT

[75] Inventors: Hanzou Taguchi; Shigeru Muramatsu; Kiyoshi Kawamura, all of Hamamatsu, Japan

[73] Assignee: Yamaha Corporation, Hamamatsu, Japan

[21] Appl. No.: 619,297

[22] Filed: Nov. 28, 1990

[30] Foreign Application Priority Data

Nov. 30, 1989 [JP] Japan ..... 1-311081

[51] Int. Cl.[5] ..... G10B 3/14; G10C 3/20; G10C 3/26; G10F 1/16

[52] U.S. Cl. ..... 84/746; 84/17; 84/22; 84/236

[58] Field of Search ..... 84/17, 20-22, 84/27-29,236-240, 721, 746, 726, 731

[56] References Cited

U.S. PATENT DOCUMENTS 4,450,749 5/1984 Stahnke ..... 84/462
4,593,592 6/1986 Stahnke ..... 84/21
4,913,026 4/1990 Kaneko et al. ..... 84/21
4,970,928 11/1990 Tamaki ..... 84/21
5,016,513 5/1991 Stahnke ..... 84/19

*Primary Examiner*—William M. Shoop, Jr.
*Assistant Examiner*—Brian Sircus
*Attorney, Agent, or Firm*—Spensley Horn Jubas & Lubitz

[57] ABSTRACT

An automatic performance device for a keyboard instrument such as piano, organ, cembalo and celesta includes operators such as keys and a pedal provided in a keyboard instrument for producing sounds, a target performance state designation unit for producing target performance information of the keyboard instrument, a real performance state detection circuit for detecting an operation state of the operators and producing a detection output, an actuator such as a solenoid for actuating the operators, and a control circuit for controlling the actuator. The control circuit detects in error between the detection output of the real performance state detection circuit and the target performance information, and generates an operator actuating signal by correcting the target performance information to eliminate the error and supplies the corrected operator actuating signal to the actuator.

12 Claims, 7 Drawing Sheets

AUTOMATIC PERFORMANCE DEVICE FOR A KEYBOARD INSTRUMENT

BACKGROUND OF THE INVENTION

This invention relates to an automatic performance device used in a keyboard instrument such as piano, organ, cembalo and celesta.

Known in the art of an automatic performance device for a keyboard instrument is one which, for example, is shown in FIG. 9.

An upright piano 1 shown in the figure has a key bed 2, a balance rail 3 provided on the upper surface of the key bed 2 at about a middle position as viewed in the figure, a key 5 which is rockably supported on the balance rail 3 through a balance pin 4, a rear rail 6 provided on the key bed 2 in the rear end portion thereof, a stop 7 made of an elastic material against which the rear lower surface of the key 5 abuts, a front rail 8 provided on the upper surface of the key bed 2 in the front end portion thereof, an oval key pin 9 which is fixed to the front rail 8 and engages with the front lower surface of the key 5 to restrict the movement of the key 5 in a direction normal to the rocking direction thereof, a string 10 provided in correspondence to the key 5 and a string striking mechanism 11 provided between the string 10 and the key 5. This string striking mechanism 11 includes a hammer 12 for striking the string 10, a damper 13 for stopping vibration of the string 10 and an action 14 which connects the hammer 12 and the damper 13 with the key 5.

An automatic performance device 15 applied to the piano 1 of the above described construction includes a solenoid 16 provided on the upper surface of the key bed 2 at a location between the rear rail 6 and the balance rail 3 and a controller 17 for actuating the solenoid 16.

The operation of this prior art automatic performance device 15 will be described below.

A key actuating signal is provided from the controller 17 to the solenoid 16 in response to a performance signal from an external input 18 and the key 5 is moved in a rocking motion with a force corresponding to the key actuating signal.

As the key 5 is moved, the damper 13 is released from the string 10 and the hammer is actuated to strike the string 10 respectively through the action 14.

Since the string striking force applied to the hammer 14 corresponds to the force applied to the key 5, the string striking force corresponding to the performance signal supplied from the external input 18 can be provided.

The prior art automatic performance device described above has the problem that, since the operation of the solenoid 16 which is actuated in response to the performance signal to move the key 5 is independent from the rocking motion of the key 5, there sometimes arises an error between the movement of the key 5 which is predetermined by the performance signal and the reproduced real movement of the key 5 for one reason or another, e.g., inertia of the key 5 during the rocking motion, so that fidelity of the reproduced performance is impaired due to this error which results in an error in tone generation timing, omission of a weak sound or the like.

It is, therefore, an object of the invention to provide an automatic performance device for a keyboard instrument which has overcome the above described problem.

SUMMARY OF THE INVENTION

The automatic performance device for a keyboard instrument achieving the above described object of the invention comprises operators provided in a keyboard instrument for producing sounds, target performance state designation means for producing target performance information of the keyboard instrument, real performance state detection means for detecting an operation state of the operators and producing a detection output actuation means for actuating the operators, and control means for controlling the actuation means comprising error detection means for detecting an error between the detection output of the real performance state detection means and the target performance information, and operator actuating signal generation means for generating an operator actuating signal by correcting the target performance information to eliminate the error and supplying the operator actuating signal to the actuation means.

According to the automatic performance device of the invention, the operation state of the operators such as keys and pedal actuating mechanism are detected by the real performance state detection means and the detected real performance state information is compared with the target performance information. The operator actuating signal supplied to the actuation means is corrected in accordance with the detected error whereby a tone of the target performance state is sounded.

Preferred embodiments of the invention will now be described with reference to the accompanying drawings.

BRIEF DESCRIPTION OF THE DRAWINGS

In the accompanying drawings.

DESCRIPTION OF PREFERRED EMBODIMENTS

Preferred embodiments of the invention will be described with reference to FIGS. 1 through 8.

Figure 1:
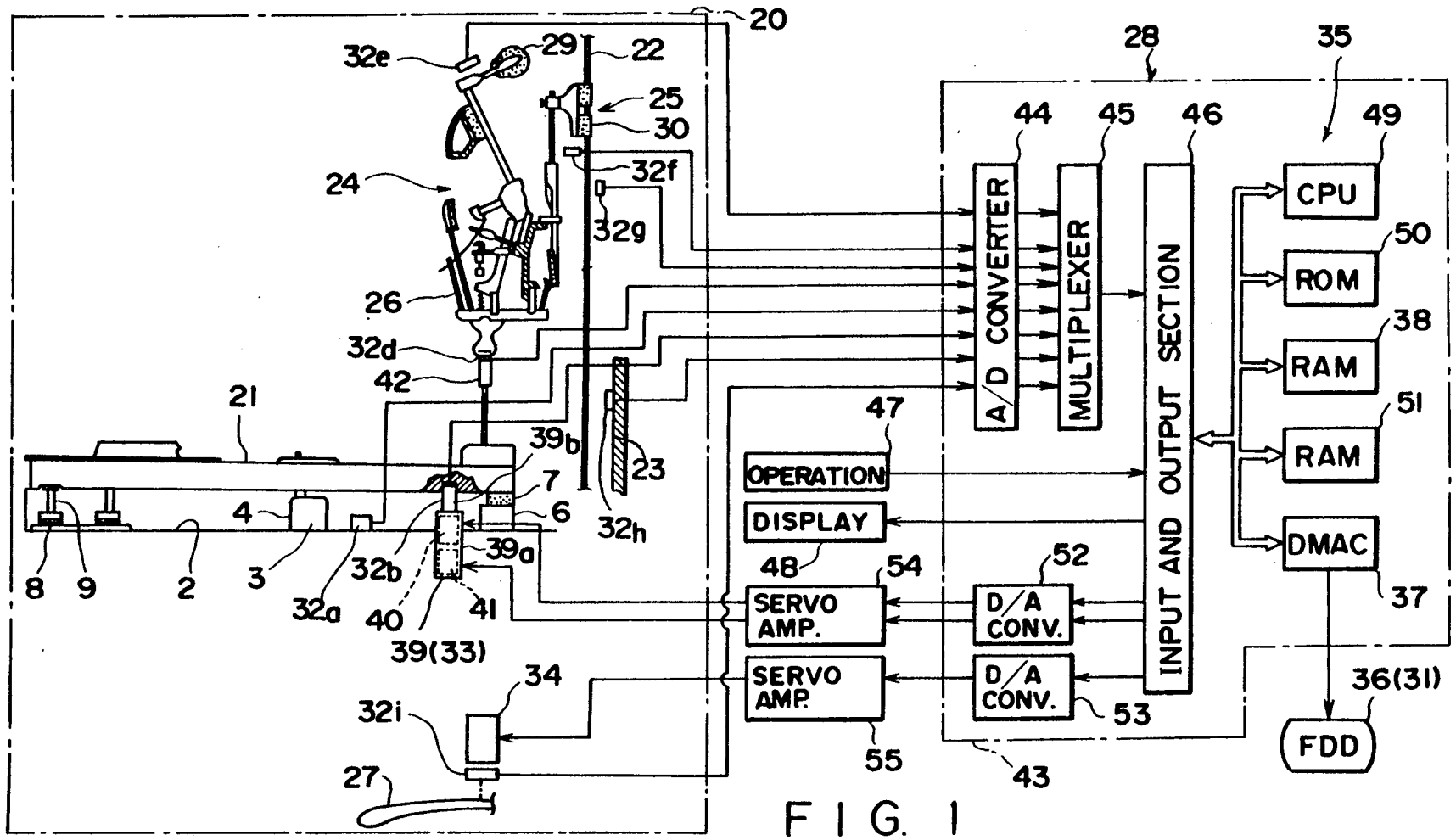
FIG. 1 is a block diagram showing an embodiment of the invention applied to an upright piano.

A keyboard instrument 20 in FIG. 1 is an upright piano which has keys 21 and strings 22 provided in correspondence to the keys 21. For convenience of explanation, only one key and corresponding string and other mechanism are illustrated and the following description will be made about the single key and corresponding mechanism. The piano 20 has further a sound board 23 provided with space from the string 22, a string striking mechanism 24, a sound stopping mechanism 25, an action 26 which connects these string striking mechanism 24 and the sound stopping mechanism 25 with the key 21, and a pedal 27 which actuates the sound stopping mechanism 25 independently of the key 21. The keys 21 and the pedal 27 constitute the operators in the present embodiment. For automatically actuating these operators, an automatic performance device (controller) 28 is provided.

The string striking mechanism 24 has a hammer 29 which is actuated by the action 26 and the sound stopping mechanism 25 has a damper 30 which is actuated by the pedal 27.

The key 21 is rockably mounted, in the same manner as in the above described prior art device, on a key bed 2 through a balance rail 3 and a balance pin 4, with its downward movement in the rocking direction being restricted by its abutting engagement at the rear lower surface with a stopper 7 of the rear rail 6 and with its movement in a direction normal to the rocking direction being restricted by its engagement with an oval key pin 9 mounted on a front rail 8.

The automatic performance device 28 includes, as its main component parts, target performance state designation means 31 for producing target performance information for the piano 20, real performance state detection means 32 for detecting operation states of the key 21 and pedal 27 of the piano 20, actuation means 33 and 34 for actuating the key 21 and the pedal 27, and control means 35 which provides an actuating signal to the actuation means 34 and 35 in response to the target performance information. The control means 35 also detects an error between the feedback signal from the real performance state detection means 32 and the target performance information and corrects the actuating signal to eliminate this error.

The target performance state designation means 31 in this embodiment is constructed of an external memory such as a floppy disk, a floppy disk drive 36 for reading information stored in the floppy disk, a direct memory access controller 37 for driving this floppy disk drive 36 and a RAM 38 for once storing the target performance information read from the floppy disk drive 36. The target performance state designation means 31 may alternatively employ an external memory such as an optical disk drive instead of the floppy disk drive 36 or, alternatively further, may be constructed of means for inputting performance information transmitted from an external source.

The actuation means 33 provided for actuating the key 21 is constructed of a solenoid 39 which is provided at a location opposite to the rear lower surface of the key 21. This solenoid 39 is mounted on the piano 20 with its body **39*a* being fixed on the surface of the key bed 2. A plunger 39*b* which is slidably mounted in the body 39*a* is in abutting engagement at its tip portion with the lower surface of the key 21 and is reciprocated in the rocking plane of the key 21 by coils 40 and 41 provided in the body 39*a*. In a modification of the embodiment, the tip portion of the plunger 39*b* may be fixed to the lower surface of the key 21** by means of, for example, a pivotal connection.

As the actuation means 34 provided for the pedal 27, a solenoid which is similar to the solenoid 39 may be employed.

The real performance state detection means 32 in the present embodiment includes the following sensors:

(a) a key sensor **32*a* provided on the upper surface of the key bed 2 at a location opposite to the lower surface of the key 21 for detecting displacement, velocity or acceleration of the key 21 by detecting inclination of the key 21**.

(b) an actuating force sensor **32*b* made of a pressure sensitive element interposed between the key 21 and the plunger 39*b* of the solenoid 39**.

(c) a capstan pressure sensor **32*d* provided on a capstan 42 which connects the key 21 with the action 26 for detecting magnitude of the force transmitted from the key 21 to the action 26**.

(d) a hammer sensor provided at a location on a frame (not shown) of the piano 20 adjacent the hammer 29 for detecting displacement, velocity or acceleration of the hammer 29.

(e) a damper sensor **32*f* provided at a location adjacent the damper 30 on the frame for detecting displacement, velocity or acceleration of the damper 30**.

(f) a string sensor **32*g* provided at a location adjacent the string 22 on the frame for detecting vibration of the string 22**.

(f) a sound board sensor **32*h* provided on the sound board 23** for detecting vibration thereof.

(g) a pedal sensor **32*i* provided in parallel with the actuation means 34 for the pedal 27 for detecting displacement, velocity or acceleration of the pedal 27**.

These sensors **32*a* to 32*i* are connected to an input and output section 46 through an analog-to-digital converter 44 and a multiplexer 45 provided in the controller 43**.

To this input and output section 46 are connected also an operation section 47 which performs switching of operation mode, e.g., between a record mode in which performance information is recorded by directly actuating the key 21 and an automatic performance mode, and a display section 48 which displays these states.

To the input and output section 46 are also connected a CPU 49 performing controls of the controller 43, a ROM 50, the RAM 38, the direct memory access controller 37 and a back up RAM 51 for these components.

To the input and output section 46 are further connected the actuation means 33 and 34 through digital-to-analog converters 52 and 53 and servo amplifiers 54 and 55. These servo amplifiers 54 and 55 function to change the direction of voltage supplied to the actuation means 33 and 34 in response to a command supplied from the digital-to-analog converters 52 and 53.

Figure 2:
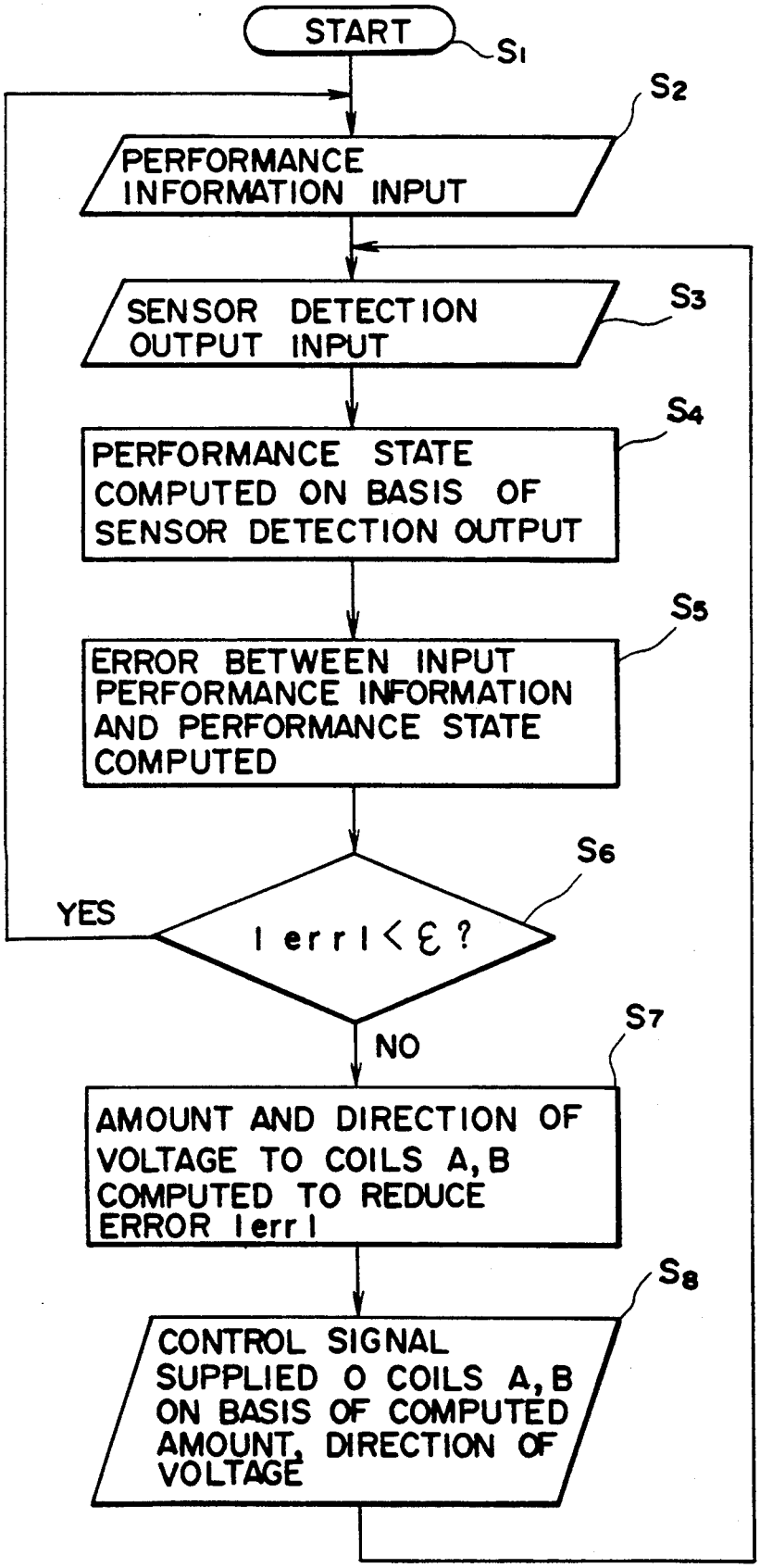
FIG. 2 is a flow chart for explaining the operation of the embodiment.

The operation of the above described embodiment will be described with reference to FIG. 2. The following description will be made about a case where a real performance state of the key 21 is controlled to attain a target operation state.

Step S1

A playback start command is given by the operation section 47 and the automatic performance device 28 is thereby started.

Step S2

Target performance information stored in a floppy disk in the floppy disk drive 36 is read out and applied to the RAM 38 through the direct memory access controller 37.

Step S3

After application of the target performance information in the RAM 38, detection signals from the key sensor 32*a*, actuating force sensor 32*b*, capstan pressure sensor 32*d*, hammer sensor 32*e*, damper sensor 32*f*, string sensor 32*g* and sound board sensor 32*h* are converted to digital signals by the analog-to-digital converter 44 and supplied to the CPU 49 through the multiplexer 45 and the input and output section 46.

Step S4

The CPU 49 computes the real performance state of the key 21, i.e., real performance information (one or more of displacement, velocity, acceleration, load of key depression, and timings of sounding and stopping a sound of the key 21, action 24, hammer 29 and damper 30) in response to the values of the respective detection signals from the sensors 32*a*, 32*b*, 32*d*, 32*e*, 32*g* and 32*h* which have been supplied in Step S3.

Step S5

The real performance information which has been computed in Step 4 is compared with the target performance information which has been loaded in Step S2 to compute an error err in displacement, velocity, acceleration, load of key depression etc. of the key 21 etc.

Step S6

The absolute value of the error |err| which has been computed in step S5 is compared with a coefficient $\epsilon$ which represents a predetermined allowance range and, when the absolute error |err| is smaller than $\epsilon$, the real performance state is regarded to have reached the target performance state and the processing returns to Step 1. When the absolute error |err| is larger than the coefficient $\epsilon$, the processing proceeds to Step S7.

Step S7

A key actuating signal (amount and direction of voltage supplied to the solenoid 39) which reduces the absolute value of the error err which has been computed in Step S5 is computed for each of the coils 40 and 41 of the solenoid 39 provided in correspondence to the key 21.

Step S8

The key actuating signal which has been computed in Step S7 is converted to an analog signal by the digital-to-analog converter 52 and applied to the coils 40 and 41 through the servo amplifier 54. Then, the processing returns to Step S3.

By the above described control, the real performance state of the key 21 reaches the target performance state whereby the target performance information is reproduced with high fidelity by performing a key return speed control and half key control with high accuracy.

Figure 3:
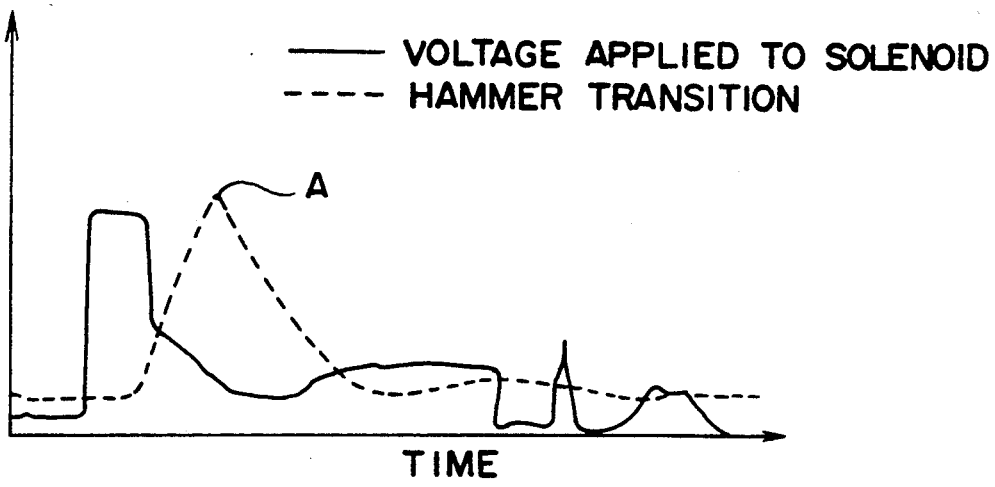
FIG. 3 is a graph showing a voltage supply pattern for the solenoid.

The voltage supply pattern to the solenoid 39 provided for the key 21 is determined in correspondence to the transition of the hammer 29 as shown in FIG. 3.

In FIG. 3, change in voltage supplied to the solenoid 39 is shown in a solid line and transition of the hammer 29 is shown in a broken line. As shown in the figure, it is possible to stop supply of voltage to the solenoid 39 before the hammer 29 has reached a string striking point A.

This arrangement makes it possible to reduce energy imparted by the solenoid 39 to the hammer 29 to a minimum amount necessary for striking the string 22.

Figure 4:
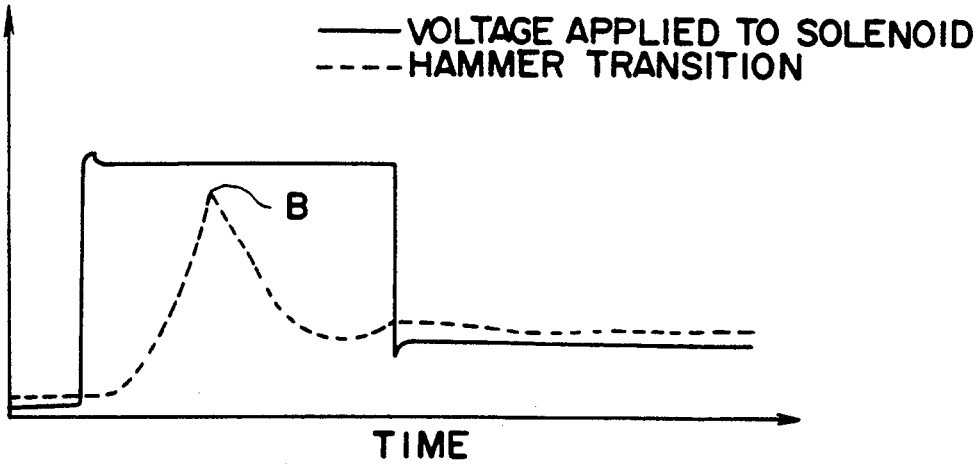
FIG. 4 PRIOR ART
FIG. 4 is a graph showing a voltage supply pattern for the solenoid in the prior art device for comparison with FIG. 3.
Figure 5:
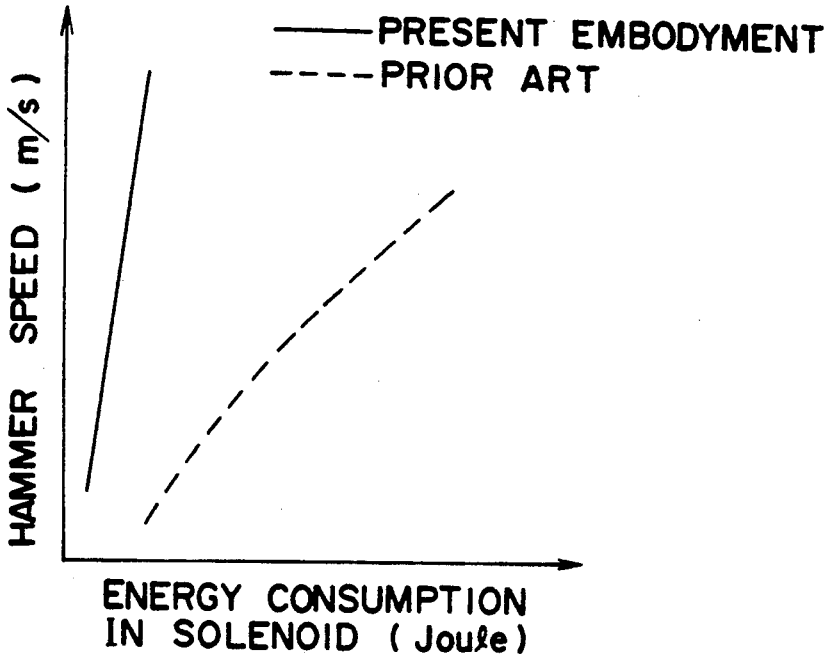
FIG. 5 is a graph showing energy consumption of the embodiment of the invention in comparison with that of the prior art device.

In the pattern of voltage supply to the solenoid 16 in the prior art automatic performance device 15, as shown in FIG. 4, voltage is supplied continuously after a string striking point B. Comparison of energy consumption in the solenoid between the voltage supply pattern in the prior art device and the voltage supply pattern in the present embodiment is shown in FIG. 5. As shown in FIG. 5, energy consumption in the solenoid in the present embodiment necessary for obtaining the same hammer speed as in the prior art device is considerably small, so that the size of the solenoid can be reduced and a lighter key touch can thereby be obtained with a result that tone color of a tone produced can be improved.

Figure 6:
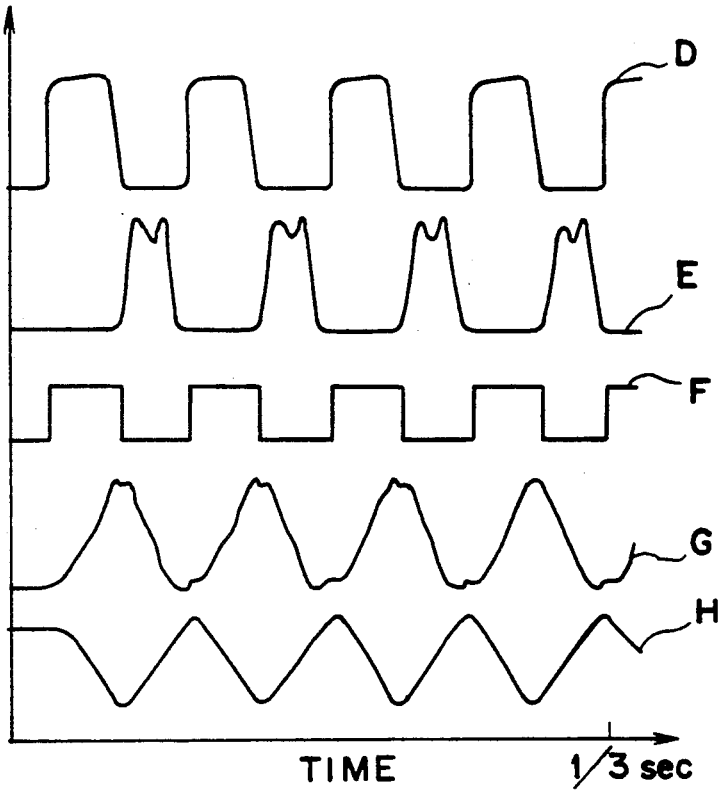
FIGS. 6 and 7 are graphs showing relationship among voltage supply pattern to the solenoid, input pulses, key displacement and hammer displacement for explaining capability of the embodiment for performing continuously repeated striking of the string.
Figure 7:
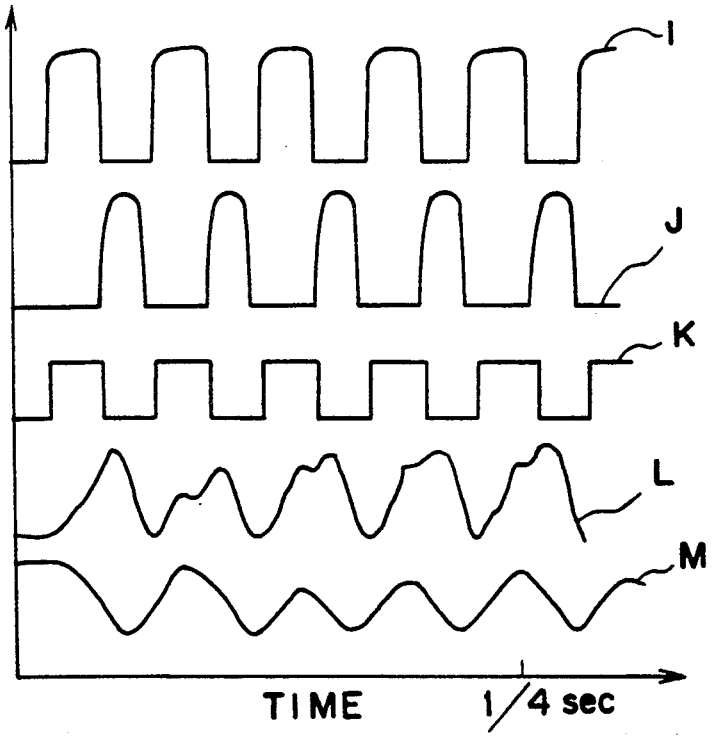
Figure 8:
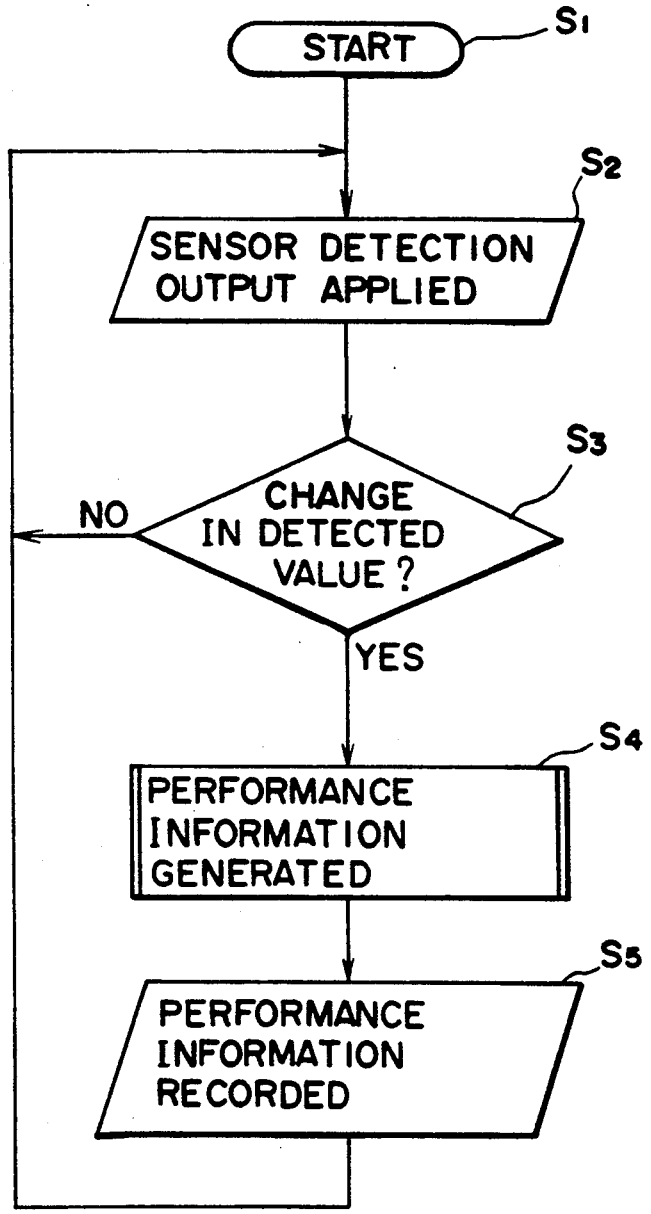
FIG. 8 is a flow chart for explaining a record mode.
Figure 9:
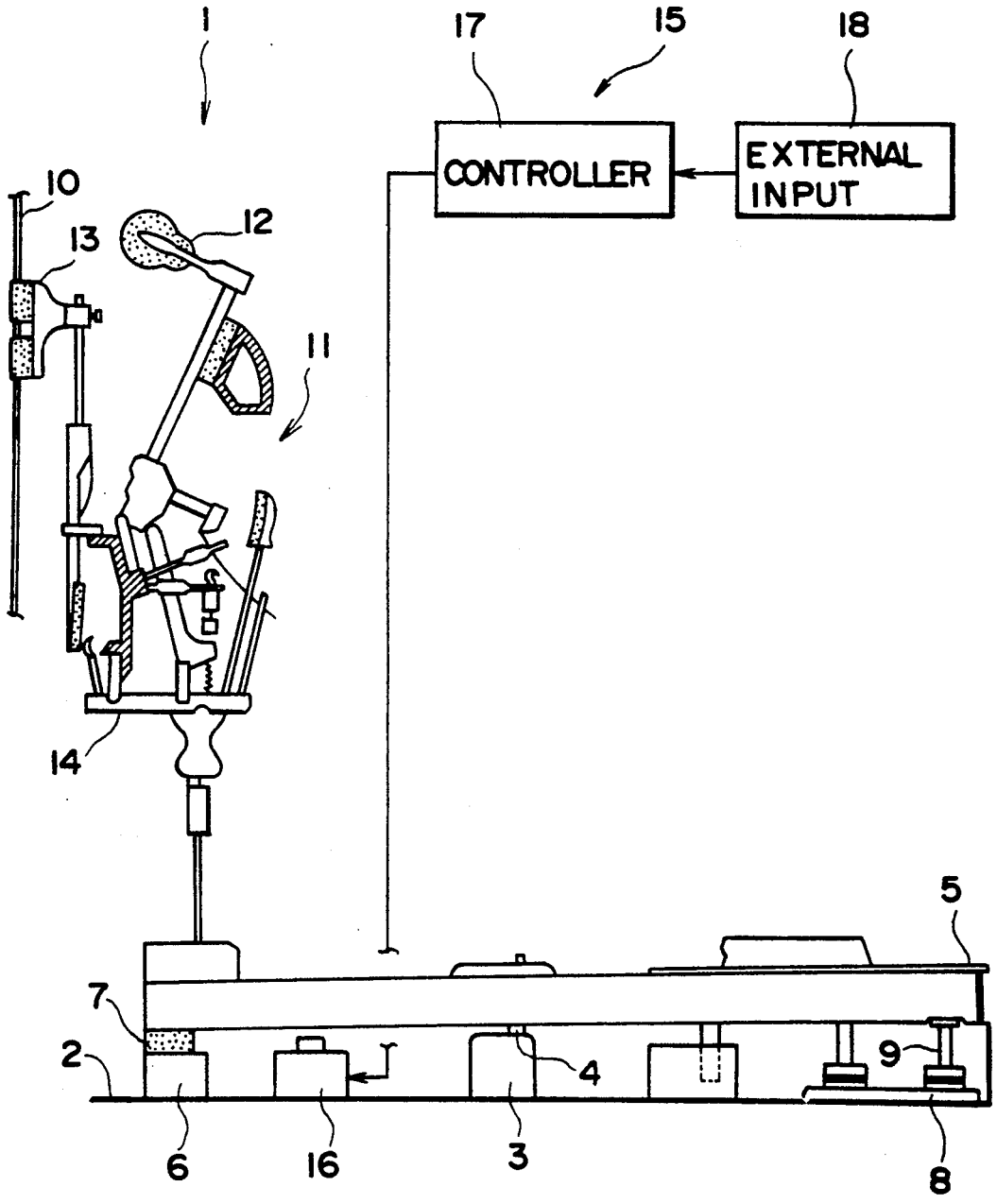
FIG. 9 PRIOR ART
FIG. 9 is a vertical sectional view of an example of the prior art automatic performance device applied to an upright piano.

Besides, by the above described control, a characteristic of rapid continuous striking of a key can be improved as shown in FIGS. 6 and 7.

FIG. 6 shows the characteristic obtained from the present embodiment in which the plunger 39*b* of the solenoid 39 is in abutting engagement against the lower surface of the key 21. In this figure, curve D represents voltage applied to the coil 40, curve E voltage applied to the coil 41, curve F an input pulse, curve G transition of the key 21 and curve H transition of the hammer 29. A continous key striking characteristic to about 12 Hz can be obtained.

FIG. 7 shows an example of a continuous key striking characteristic obtained in a case where the plunger 39*b* of the solenoid 39 is connected pivotably to the key 21. In this figure, curve I represents voltage applied to the coil 40, curve J voltage applied to the coil 41, curve K an input pulse, curve L transition of the key 21 and curve M transition of the hammer 29. In this example, a continuous key striking characteristic to 16 Hz can be realized.

Since normal continuous key striking capability of an upright piano is 7–8 Hz, a continuous key striking characteristic which is almost equal to that of a grand piano can be obtained in an upright piano according to the present embodiment, so that target performance information recorded by using a grand piano can be reproduced by an upright piano.

The automatic performance device 28 according to the present embodiment has also a function of recording performance information. The operation for recording performance information will be described with reference to FIG. 8.

Step S1

The automatic performance device 28 is started by operating the operation section 41.

Step S2

Signals from the key sensor 32*a*, capstan pressure sensor 32*d*, hammer sensor 32*e*, damper sensor 32*f*, string sensor 32*g* and sound board sensor 32*h* are applied to the CPU 49 through the analog-to-digital converter 44, multiplexer 45 and input and output section 46.

Step S3

Whether the signals from the respective sensors 32*a*, 32*d*, 32*e*, 32*f*, 32*g* and 32*h* have changed or not is judged. If there is no change, the processing proceeds to Step S2 whereas if there is a change, the processing proceeds to Step S4.

Step S4

Responsive to the signals from the respective sensors 32*a*, 32*d*, 32*e*, 32*f*, 32*g* and 32*h*, performance information (transition of the key and action, speed, acceleration, load, timing of sounding and stopping of a tone) is generated (e.g., the signal is converted to a MIDI signal). Then, the processing proceeds to Step S5.

Step S5

Performance information prepared in Step S4 is recorded in the floppy disk by the floppy disk drive 36 through the direct memory access controller 37.

By virtue of this function, the player can recognize his performance from objective standpoint so that it will help test hearing his performance skill and repeated training.

Configurations, locations and manner of control of the components of the above described embodiment have been described by way of example only and these configurations, locations and manner of control can be modified in various manners depending upon design requirements.

For example, the floppy disk drive 36 may be replaced by a system which receives performance information transmitted from an external device and transmits performance information to the external device.

In the above described embodiment, target performance information is set for the key 21 and real performance state of the key 21 is detected, and actuation of the key 21 is controlled by using the real performance information as a feedback signal. Additionally, performance information of the pedal 27 is added to the target performance information and the actuation means 34 provided for the pedal 27 is actuated by using the real performance information of the pedal 27 from the pedal sensor 32*i* whereby the operation state of the pedal 27 is controlled concurrently with the control of the operation state of the key 21.

Summing up, the following benefits can be obtained from the automatic performance device according to the invention.

By detecting the real performance state of the operator such as a key and correcting an actuating signal supplied to the actuation means for actuating the operator by using the detected value of the real performance state as a feedback signal, the real performance state can be caused to coincide with the target performance state whereby the target performance information can be reproduced with high fidelity.

By performing a servo control using a touch pattern of key depression as a target value, key touch of a grand piano can be obtained by an upright piano. Besides, the key touch can be controlled to a desired subtle touch.

By suitable determining a pattern of voltage supply to the actuation means, energy consumption in the actuation means can be reduced to a minimum value necessary for striking the string, so that a light key touch can be obtained with a resulting improvement in the tone color.

According to the invention, the reproducing ability of a grand piano can be improved and a continuous key striking characteristic in an upright piano can be improved to that of a grand piano.

What is claimed is:

1. An automatic performance device for a keyboard instrument comprising:

operators provided in the keyboard instrument for producing sounds;

target performance state designation means for producing target performance information for the keyboard instrument;

real performance state detection means for detecting an operation state of the operators and producing a detection output, wherein said keyboard instrument includes actions, hammers, dampers, strings and a sound board, and said real performance state detection means includes a damper sensor provided at a location on a frame adjacent one of the dampers for detecting transition, velocity or acceleration of the damper and a string sensor provided at a location on the frame adjacent one of the strings for detecting vibration of the string;

actuation means for actuating the operators;

control means for controlling the actuation means comprising error detection means for detecting a difference between the detection output of the real performance state detection means and the target performance information; and operator actuating signal generation means for generating an operator actuating signal for correcting the target performance information to eliminate the difference and supplying the operator actuating signal to the actuation means.

2. An automatic performance device as defined in claim 1 wherein said operators comprise keys provided in a keyboard of the keyboard instrument.

3. An automatic performance device as defined in claim 2 wherein said operators further comprise a pedal which actuates a sound stopping mechanism provided in the keyboard instrument.

4. An automatic performance device as defined in claim 2 wherein said real performance state detection means detects at least one of transition, velocity, acceleration, and load of key depression and sound generating or ceasing timing of the operators and at least one component of the actions, hammers, dampers, strings and sound board.

5. An automatic performance device as defined in claim 2 wherein said real performance state detection means is a key sensor provided on the upper surface of a key bed at a location opposite to a key in the keyboard for detecting transition, velocity or acceleration of the key by detecting inclination of the key.

6. An automatic performance device as defined in claim 2 wherein said actuation means is a solenoid and said real performance state detection means is an actuating force sensor made of a pressure sensing element interposed between a key in the keyboard and a plunger of the solenoid.

7. An automatic performance device as defined in claim 4 wherein said real performance state detection means is a capstan pressure sensor provided on a capstan connecting a key in the keyboard with one of the actions for detecting magnitude of force transmitted from the key to the action.

8. An automatic performance device as defined in claim 4 wherein said real performance state detection means is a hammer sensor provided at a location on a frame opposite to one of the hammers for detecting transition, velocity or acceleration of the hammer.

9. An automatic performance device as defined in claim 4 wherein said real performance state detection means is a sound board sensor provided on the sound board for detecting vibration of the sound board.

10. An automatic performance device as defined in claim 3 wherein said real performance state detection means is a pedal sensor provided in parallel with the actuation means for the pedal for detecting transition, velocity or acceleration of the pedal.

11. An automatic performance device as defined in claim 2 wherein said actuation means is a solenoid which is pivotably connected to the lower surface of each of the keys.

12. An automatic performance device for a keyboard instrument having actions, hammers, dampers, strings and a soundboard, said automatic performance device comprising:

operators provided in the keyboard instrument for producing sounds, said operators comprising keys provided in a keyboard of the keyboard instrument;

target performance state designation means for producing target performance information for the keyboard instrument;

real performance state detection means for detecting an operation state of the operators and producing a detection output, wherein said real performance state detection means detects at least one of transition, velocity, acceleration, load of key depression and sound generating or ceasing timing of the operators and at least one component of the actions, hammers, dampers, strings and soundboard, and wherein said real performance state detection means includes a hammer sensor provided at a location of a frame adjacent one of the hammers for detecting transition, velocity or acceleration of the hammer and a string sensor provided at a location on the frame adjacent one of the strings for detecting vibration of the string;

actuation means for actuating the operators;

control means for controlling the actuation means comprising error detection means for detecting a difference between the detection output of the real performance state detection means and the target performance information; and operator actuating signal generation means for generating an operator actuating signal for correcting the target performance information to eliminate the difference and supplying the operator actuating signal to the actuation means, wherein said control means stops, in response to an output from the hammer sensor, supply of the operator actuating signal to said actuation means before the hammer reaches the position at which the hammer strikes the string.

* * * * *